United States Patent [19]

Dischler

[11] Patent Number: 4,918,795

[45] Date of Patent: Apr. 24, 1990

[54] METHOD TO SOFTEN FABRIC BY AIR IMPINGEMENT

[75] Inventor: Louis Dischler, Spartanburg, S.C.

[73] Assignee: Milliken Research Corporation, Spartanburg, S.C.

[21] Appl. No.: 391,690

[22] Filed: Aug. 10, 1989

Related U.S. Application Data

[60] Continuation of Ser. No. 243,201, Sep. 8, 1988, abandoned, which is a continuation of Ser. No. 171,261, Mar. 21, 1988, abandoned, which is a division of Ser. No. 74,568, Jul. 17, 1987, Pat. No. 4,837,902.

[51] Int. Cl.[5] ..... D06C 19/00

[52] U.S. Cl. ..... 26/1; 15/306 A; 26/18.5; 34/23

[58] Field of Search ..... 26/1, 18.5

[56] References Cited

U.S. PATENT DOCUMENTS

| | | | |
|---|---|---|---|
| 300,964 | 6/1884 | Garnier . | |
| 392,082 | 10/1888 | Turner | 15/306 A |
| 502,903 | 8/1893 | Fries . | |
| 2,730,786 | 1/1956 | Kindstrand et al. . | |
| 2,740,202 | 4/1956 | Fowle | 34/155 X |
| 2,972,177 | 2/1961 | Bidgood, Jr. . | |
| 3,078,496 | 2/1963 | Doran et al. | 15/306 A X |
| 3,775,806 | 12/1973 | Olbrant et al. | 15/306 A |
| 3,914,834 | 10/1975 | Hatay . | |
| 3,925,865 | 12/1975 | Christian . | |
| 4,055,003 | 10/1977 | Sack | 34/156 X |
| 4,112,558 | 9/1978 | Christian . | |
| 4,286,395 | 9/1981 | Hoersch . | |
| 4,339,856 | 7/1982 | Sando et al. . | |
| 4,345,385 | 8/1982 | Sando et al. . | |
| 4,365,424 | 12/1982 | Hoersch . | |
| 4,409,709 | 10/1983 | Sando et al. . | |
| 4,575,952 | 3/1986 | Bodenan et al. | 34/156 X |

FOREIGN PATENT DOCUMENTS

| | | | |
|---|---|---|---|
| 0012731 | 6/1980 | European Pat. Off. | 34/156 |
| 662640 | 5/1979 | U.S.S.R. | 26/18.5 |
| 711210 | 1/1980 | U.S.S.R. | 26/18.5 |
| 595444 | 10/1981 | U.S.S.R. | 26/18.5 |
| 1252411 | 8/1986 | U.S.S.R. | 26/18.5 |

*Primary Examiner*—Werner H. Schroeder
*Assistant Examiner*—Bradley K. DeSandro
*Attorney, Agent, or Firm*—Earle R. Marden; H. William Petry

[57] ABSTRACT

An apparatus and method of treating fabric by directing low pressure air at near-sonic velocity between the fabric and a rigid plate tangentially in the warp direction of the fabric to cause the fabric to vibrate at extremely high rate. This high speed vibration causes sawtooth waves in the fabric to break fiber-to-fiber resin or finish bonds thereby decreasing the bending and shear stiffness to enhance the flexibility, drape and softness of the fabric.

2 Claims, 3 Drawing Sheets

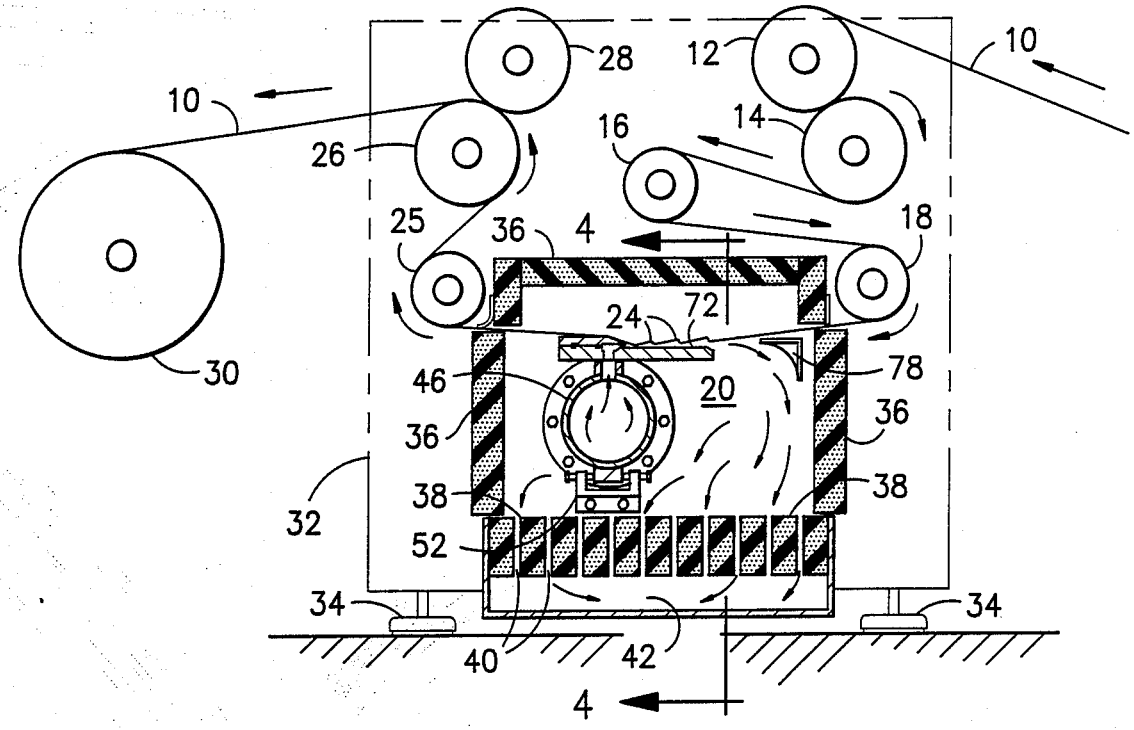
FIG. — 1 —
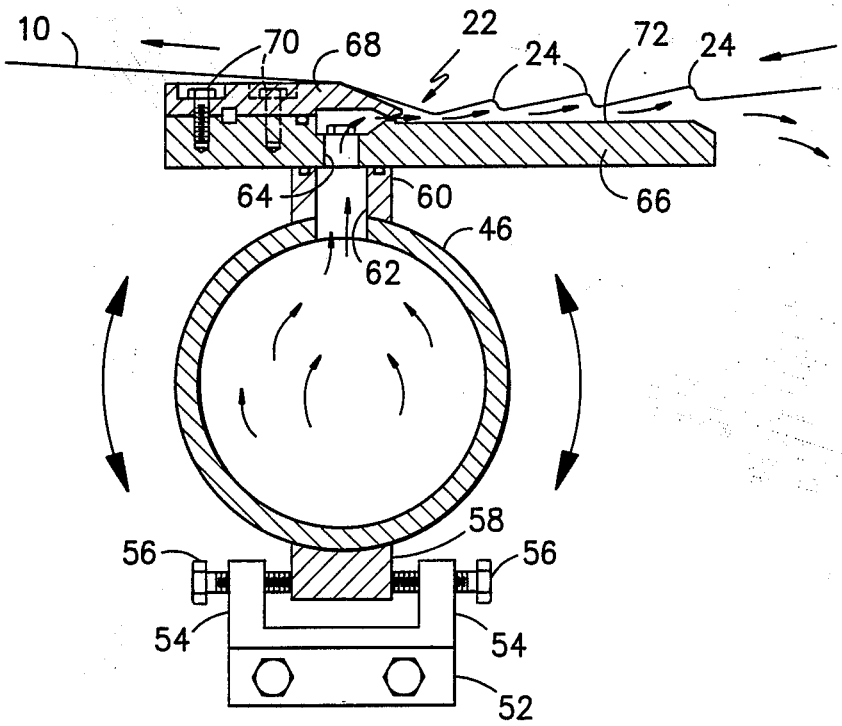
FIG. — 2 —

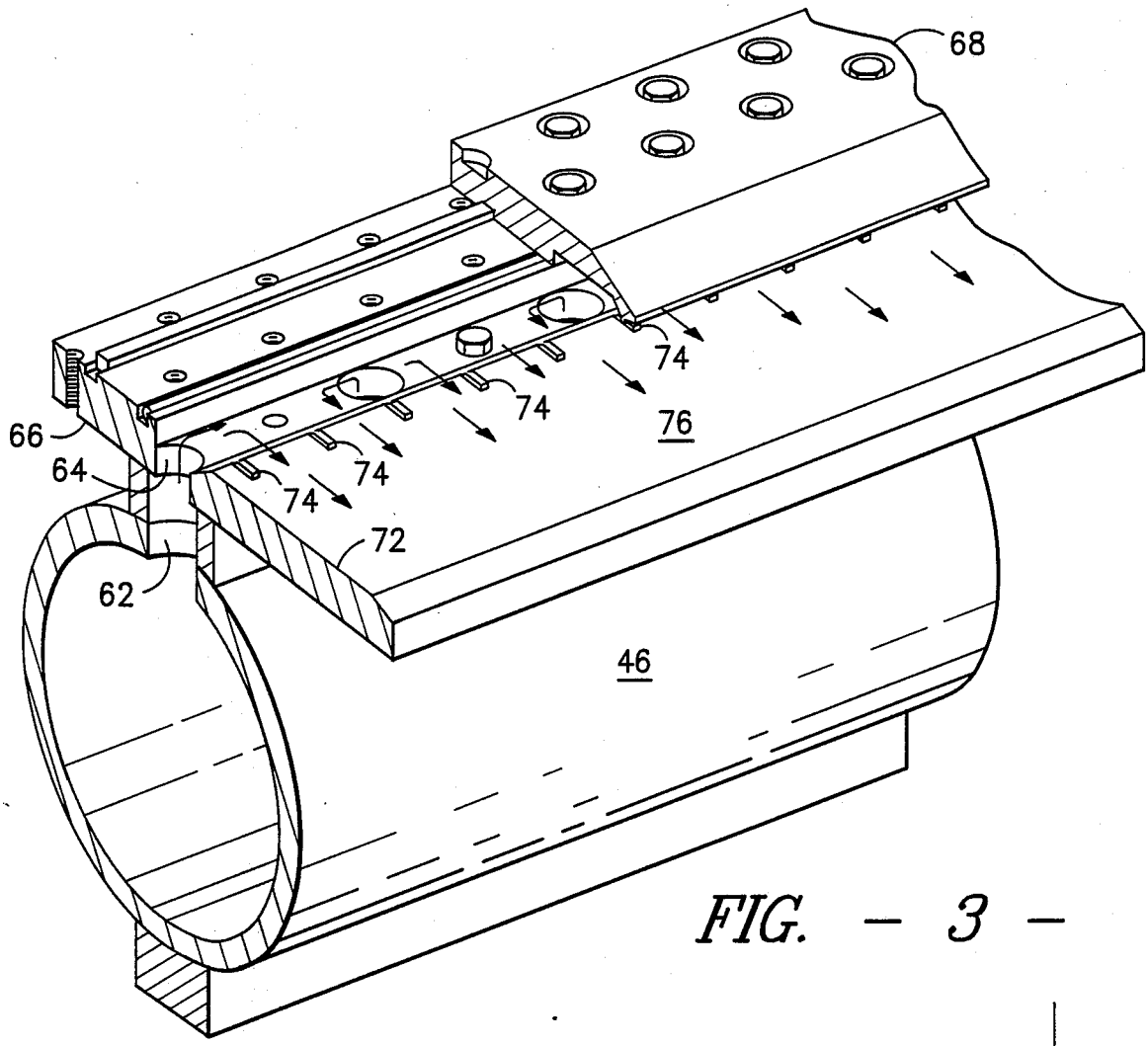
FIG. – 3 –
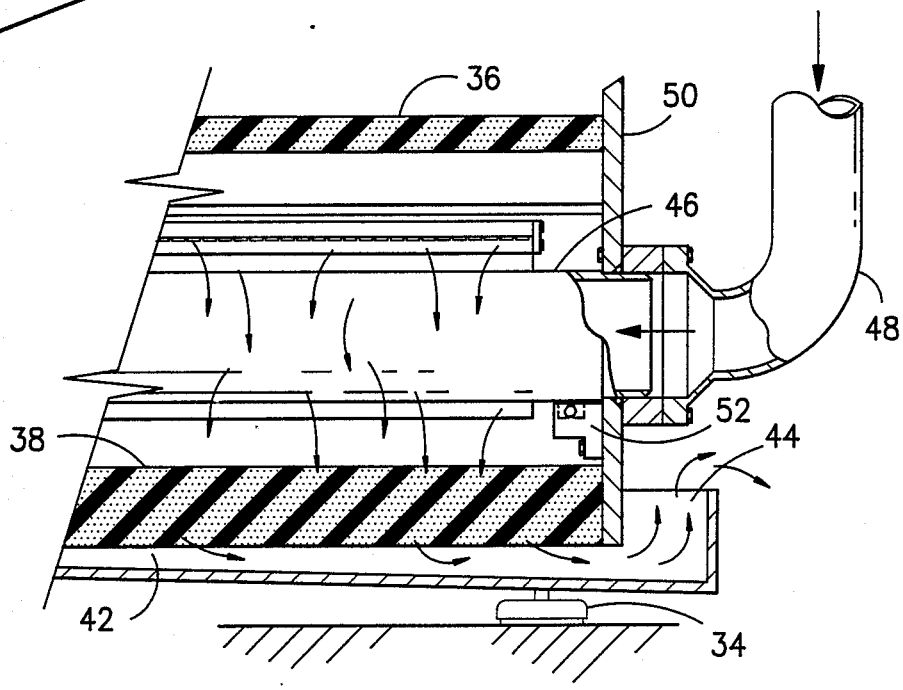
FIG. – 4 –

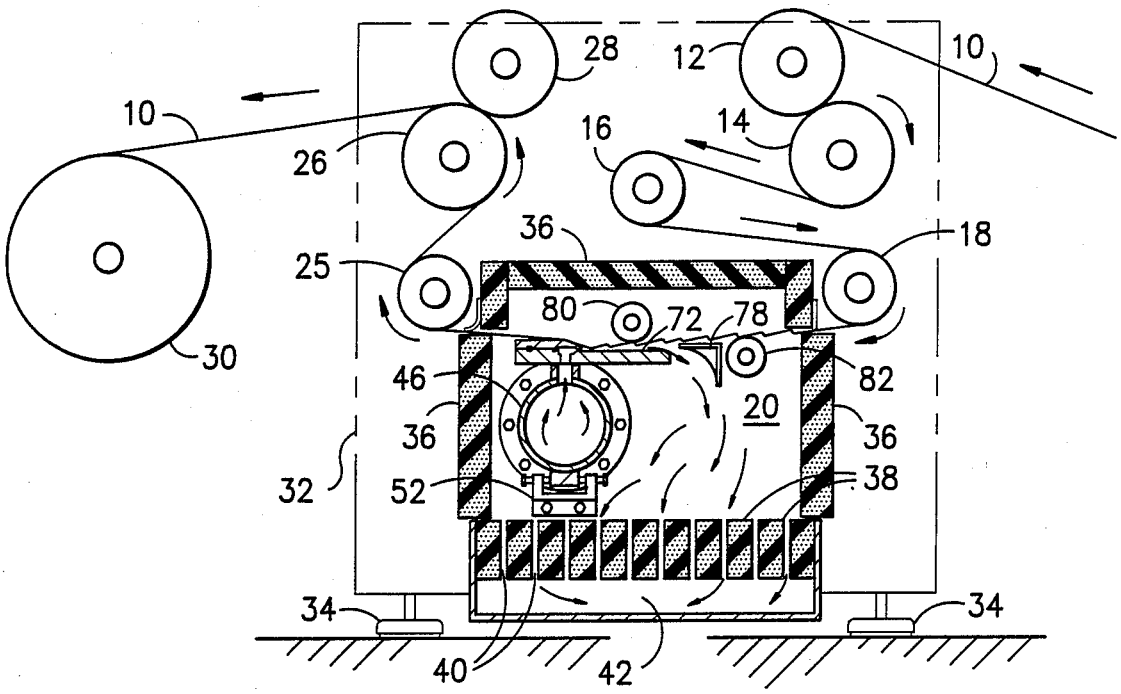
FIG. – 5 –
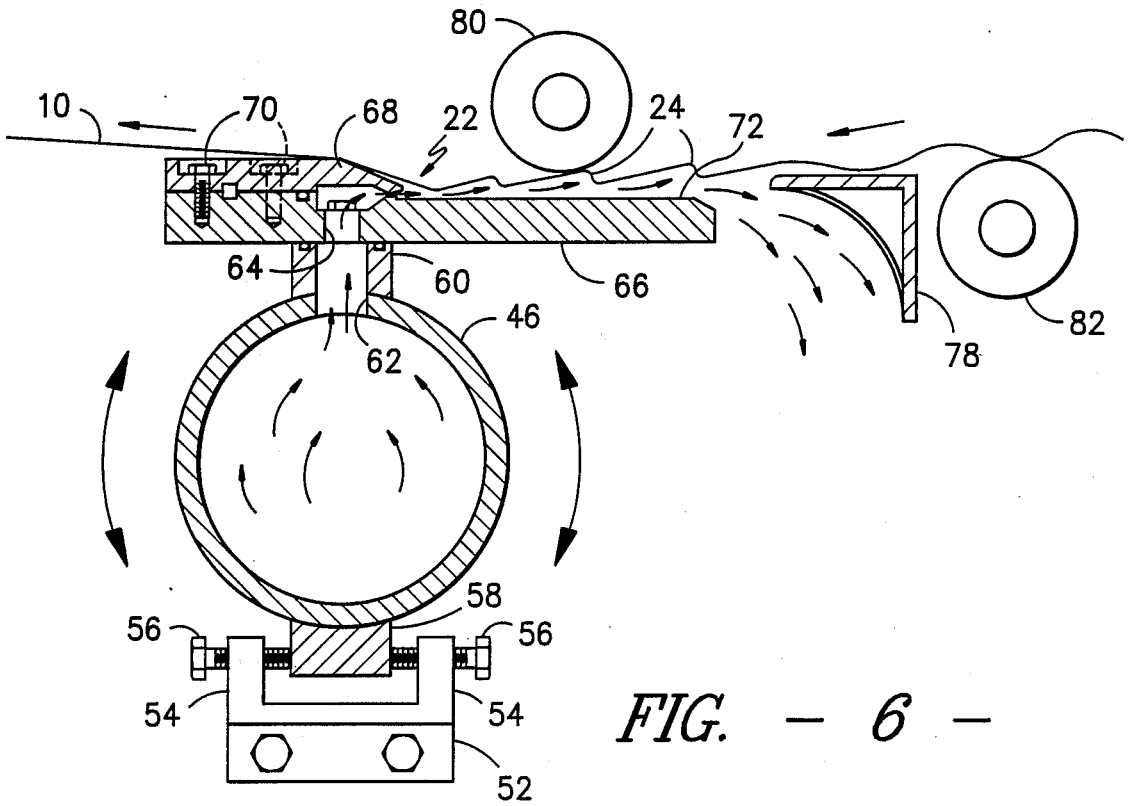
FIG. – 6 –

METHOD TO SOFTEN FABRIC BY AIR IMPINGEMENT

This is a continuation of application Ser. No. 243,201 filed Sept. 8, 1988 abandoned for METHOD TO SOFTEN FABRIC BY AIR IMPINGEMENT, which in turn is a continuation of Ser. No. 171,261, filed on March 21, 1988 abandoned of Louis Dishchler for METHOD TO SOFTEN FABRIC BY AIR IMPINGEMENT, which in turn was a division of Ser. No. 074,568, filed on July 17, 1987 now U.S. Pat No. 4,837,902 of Louis Dishchler for METHOD TO SOFTEN FABRIC BY AIR IMPINGEMENT.

This invention relates to a method and apparatus for pneumatically conditioning textile materials and more particularly to a method and apparatus for treating textile materials to soften them and to provide them with a fuller hand without significantly adversely affecting either the surface of the material or its strength characteristics.

Textile materials, such as fabrics, may be characterized by a wide variety of complex functional and aesthetic characteristics which determine commercial success or failure of the material. Examples of typical functional characteristics of a material which may be regarded as important in the textile arts include strength, abrasion resistance, stretch, soil repellence, soil release, water and oil repellence, moisture absorption and moisture regain, etc. Typical aesthetic characteristics of a textile material which may be considered in its evaluation for a particular end use are color, pattern, texture, fabric "surface feel" and "hand." It is perhaps the latter two, difficult-to-define, aesthetic characteristics with which the subject matter of the present invention is most directly and clearly concerned; however, modification of those characteristics of a fabric may affect other functional or even aesthetic characteristics in a positive or negative way, and consequently, there may be occasion throughout this disclosure where reference to those other related and interdependent characteristics of a textile material may become relevant, requiring some discussion.

Concerning characteristics of a textile material which are most significant with regard to the process and apparatus of the present invention, namely those of fabric surface feel or hand, any quantification of those characteristics in manageable, easily understood terms has been largely unsuccessful. Out of necessity the art has developed a range of descriptive, subjective terms, which are understood and which convey highly relevant information to those skilled in the textile arts. Some terms which have been used to describe fabric hand include: light, heavy, bulky, stiff, soft, harsh, full, silky, papery, thin, raggy, and so forth.

The hand of a textile material, such as a fabric, is determined by the particular raw materials used in its construction, the size and shape of the fibers employed, fiber surface contour, fiber surface frictional characteristics, yarn size, type, e.g., filamentary or spun, construction of the fabric, e.g., woven, knit, fabric weight, by the chemical finishes applied to the fabric, such as softeners, and by the processing history, including any mechanical working of the fabric. It is the last mentioned technique, that of mechanical working of the fabric, with which the process and apparatus of the present invention is most directly concerned.

A variety of techniques, some of which are used commercially today, are known in the textile art for mechanically conditioning textile sheet materials to change their aesthetic qualities. Such techniques include fulling techniques, Sanforizing, rubber-belting, jet rope scouring, and the technique of overfeeding the material on the tenter frame. The technique of mechanically impacting or beating textile materials, the general type of mechanical technique with which the present invention is concerned, has also been known for many years. Such techniques have been disclosed, for instance, as early as the late 1800's in U.S. Pat. Nos. 87,330 and 373,193. The use of flexible beating means such as thongs inserted in a shaft or tube for improving the appearance of a wide variety of materials including textile materials is also known as disclosed, for instance, in U.S. Pat. No. 2,187,543. It is further known that both the face of the textile material and the back thereof may be simultaneously subjected to mechanical impact with an impact means. Such a technique is disclosed in U.S. Pat. No. 1,555,865. Exemplary of the more recent patent art on the subject of mechanical conditioning of textile materials is the so-called "button breaker" technique which is disclosed, for instance, in U.S. Pat. No. 3,408,709. Other patents pertinent to this technique would be U.S. Pat. Nos. 4,316,928, 4,468,844, 4,512,065 and 4,631,788.

All of the presently known techniques for mechanically finishing textile materials, however, suffer from one or more significant disadvantages. In certain instances, the effect achieved may not be sufficiently significant to justify the additional processing step involved. The technique may not be performable on a continuous basis, or it may be so severe that it produces one or more undesirable effects upon other functional and/or aesthetic characteristics such as significant breaking of surface fibers or undue weakening of the overall strength of the textile material. It would thus be very desirable to provide a process and apparatus which can be employed to treat textile sheet materials continuously to achieve a desirable conditioning of the material, especially the hand thereof, while minimizing or eliminating undesirable effects upon other commercially important aesthetic and functional characteristics.

The present invention also relates to an apparatus by means of which the above-described method may be performed. Such apparatus comprises means for moving a textile sheet material, means for subjecting successive adjacent sections of the material across the entire width of the material to violent working with air jet means. Preferably, the construction of the air jet means and positioning thereof relative to the material should be such as to maximize the action applied thereto.

According to an embodiment of the invention, the textile material may be heated above ambient temperature at the time of impact with the jet means. Such heating step may be performed at or just prior to impact. Typically, for a thermoplastic material, the material may be heated to a temperature just above the glass transition temperature of the material at the time of impact with the jet means.

In another embodiment of the apparatus and process, heating of the material may be performed, for instance, on a non-heat set material just after action with said air jet means but preferably prior to the application of any substantial pressure or stretching forces to the material.

In yet another embodiment, a chemical may be applied to the textile material in an amount sufficient to enhance or change the effect achieved by means of the mechanical impacting step. Thus, for instance, where the textile material is made predominantly of a polymeric material, the chemical may be a plasticizer for the polymeric material.

In general, the phrase "conditioning" as used herein refers to a change of fabric hand or other related or separate fabric characteristics such as bulk, fullness, softness, drape and thickness. The specific conditioning effect achieved may depend, not only upon the process and apparatus variables, but also upon the character and construction of the textile material per se. Examples of such materials include pile fabrics, woven, knit, nonwoven fabrics, as well as coated fabrics and the like. Examples of knit fabrics include double knits, jerseys, interlock knits, tricots, warp knit fabrics, weft insertion fabrics, etc. Woven fabrics may be plain weaves, twills or other well-known constructions. Such fabrics may be constructed from spun or filament yarns or may be constructed by using both types of yarns in the same fabric. Fabrics made from natural fibers such as wool, silk, cotton, linen may also be treated, although the preferred fabrics are those made from synthetic fibers such as polyester fibers, nylon fibers, acrylic fibers, cellulosic fibers, acetate fibers, their mixtures with natural fibers and the like.

A particularly noticeable and desirable softening effect upon textile materials has been observed in a preferred embodiment on resin finished fabrics made from a comparatively "open" construction, such as those having "floats," e.g., twills. Resin finished fabrics made from low twist spun yarns may be particularly desirable to treat according to the invention, especially if they are also characterized by open construction.

Another of the wide variety of conditioning effects that may be achievable by means of the process and apparatus of the present invention has been observed where range dyed fabrics are processed according to the invention. In this regard, it has been observed that continuous dyeing, that is range dyeing of fabrics, especially spun, polyester-cotton greige fabrics and polyester filament-containing fabrics, typically may provide products characterized as having a thin, papery, stiff and harsh hand. Commercial acceptability of such fabrics has thus frequently required application of a chemical softener to it to improve the hand characteristics. These softeners, however, may add undesirably to the cost of the final product; and they may wash out of the fabric, especially after repeated laundering. Jet dyeing of the identical greige fabric, which is a more expensive batch-type operation, by contrast, may provide a product having a very desirable smooth and full hand as well as good drape characteristics. Processing of such range dyed fabrics according to the present invention, however, may provide products having hand characteristics that are very similar, if not indistinguishable, from the corresponding jet dyed products.

In another embodiment, the process has been found to have a very desirable effect on the appearance and surface feel of a wide variety of pile fabrics, such as tufted fabrics, plushes, velvets and the like. When employed on tufted fabrics such as, e.g., upholstery fabrics, the process may accomplish an untwisting and "opening up" or separation of the fibers in the tufted yarns giving the resulting product a much fuller, much more uniform appearance. Such processing may also provide a much more desirable, softer, silkier, more luxurious surface feel to the fabric. On velvet fabrics, an enhancement of the fabric surface luster has been observed. Another desirable effect of the use of the process on pile fabrics may be the removal of undesired fiber fly and other loose materials entrapped in the pile.

In a further embodiment, polyester filament fabrics may lose their undesirable "plastic-like" feel and the hand of such fabrics may become more similar to fabrics made entirely from natural fibers such as wool or cotton.

Other objects and advantages of the invention will become readily apparent as the specification proceeds to describe the invention with reference to the accompanying drawings in which:

FIG. 1 is a schematic representation of the system to treat the web of fabric;

FIG. 2 is a blow-up view of the low pressure, high velocity air jet arrangement;

FIG. 3 is a perspective view of the air jet arrangement;

FIG. 4 is a view taken on line 4—4 of FIG. 1, and

FIGS. 5 and 6 are views similar to FIGS. 1 and 2, respectively, showing a modification of the invention.

Looking now to the drawings, the preferred form of the invention is shown in FIGS. 1–4 with the overall scheme shown in FIG. 1. The fabric 10 to be conditioned is supplied from a supply roll (not shown) into the nip of rolls 12, 14, from which it passes over an adjustable roll 16 and an idler roll 18 into the conditioning chamber 20. The roll 16 can be adjusted inward and outward to set the tension in the fabric IC as it is being supplied over the air jets 22. The fabric 10 is acted upon by high velocity, low pressure air from the air jets 22 to cause saw-tooth waves 24 to form in the fabric. From the conditioning chamber 20, the fabric 10 is guided by idler scroll roll 25 to take wrinkles out of the fabric and guide it into the nip of rolls 26, 28 prior to be taken up by take-up roll 30. Rolls 12, 14 and 26, 28 are geared together through a differential to allow the speed of one pair of nip rolls to be varied with respect to the speed of the other pair of nip rolls as the fabric is pulled through by the take-up roll.

The conditioning chamber 20 as well as the heretofore described fabric rolls are supported by a suitable frame structure 32, schematically represented by dot-dash lines, supported on suitable feet 34. The walls of the conditioning chamber 20 are lined with acoustical insulation 36 to absorb the noise generated by the high velocity air. The bottom of the chamber 20 also has a plurality of acoustical insulation members 38 mounted thereon and spaced from one another to provide gaps 40 therebetween for the passage of air into the chamber 42 from whence it is exhausted to the atmosphere through opening 44.

As discussed briefly before, the chamber 20 is the treatment chamber wherein the fabric 10 is contacted by low pressure, high velocity air to form vibrations therein causing the saw-tooth waves 24 to form. The fabric 10, at very low tension, travels through the chamber 20 at a rate in the range of 5 ypm to 120 ypm. The low pressure, high velocity air directed towards the fabric causes the fabric to vibrate at 500 to 1000 Hz so that the waves 24 travel down the fabric at about 200 ft./second. As previously discussed, the waves 24 are typically saw-tooth in shape resulting in small bending radii at the troughs. These sharp radii, combined with the fast propagation of the wave down the fabric seem to break the fiber to fiber resin or finish bonds therebetween, thereby decreasing the bending and shear stiffness of the fabric to increase the flexibility and drape. Also, the passage of the saw-tooth waves down the fabric generates high accelerations, i.e., several hundred times the force of gravity, which causes the removal of loosely bound debris therefrom resulting in a smoother fabric surface.

To accomplish the above effect, the apparatus shown in detail in FIGS. 2–4, as well as FIG. 6, is employed. The air to be directed towards the fabric 10 is supplied at a pressure of about 30 p.s.i.g. into the manifold 46 via conduit 48 connected to the side wall 50 of the chamber 20. The manifold 46 extends transverse to the direction of travel of the fabric 10 in the conditioning chamber 20 and is supported in a bracket 52 mounted to each end wall of the chamber 20. Each bracket 52 has a pair of flanges 54 extending upwardly through which is threaded an adjustment screw 56 which engages the flange 58 on the bottom of the air manifold 46 to allow the manifold to be rotated to provide concise positioning of the air jets relative to the fabric 10 as it passes through the chamber 20.

Welded or otherwise secured to the top of the air manifold 46 is a support collar 60 in communication at the bottom with the air manifold through holes 62 to supply low pressure air to the opening 64 in the nozzle plate 66 connected thereto. The nozzle plate 66, along with the upper nozzle plate 68 secured thereto by suitable screws 70 cooperate to form a plurality of converging-diverging air jets 22 to direct the compressed air tangentially in the warp direction between the fabric 10 and the extended plate portion 72 of the lower jet plate 66.

The elongated air jets 22 are formed between the raised portions 74 left after the surface 76 has been milled and the upper nozzle plate 68 has been secured into position with a tapered portion thereof abutting the top of the raised portions so that the low pressure air from the manifold passes through the space between adjacent portions 74. A deflector plate 78 is mounted facing the air existing from the air jets 22 to direct the ejected air downward through the gaps 40 into the chamber 42 and out the opening 44 to the atmosphere. If desired the portions 74 can be eliminated to form a single continuous elongated air jet.

In the preferred form of the invention shown in FIGS. 1–4, the gaseous fluid employed is low pressure, high velocity air which is supplied tangentially to and opposite to the direction of travel of the low tensioned fabric 10 being conditioned. Varied effects can be accomplished, depending on the fabric being run, by varying the temperature of the gaseous fluid, speed of the fabric, tension on the fabric, direction of impingement of the gaseous fluid, etc. These variables may be altered separately or in combination but still fall within the concept of pneumatic working of the fabric without physical contact with a mechanical apparatus such as described previously.

FIGS. 5 and 6 show a modification of the invention of FIGS. 1–4 in that two additional rolls 80 and 82 are employed to treat both sides of the fabric 10. The rolls 80 and 82 can be stationary, idlers or be driven with or against the fabric flow and may be covered with an abrasive material. The roll 80 located above the plate extension 66 prior to the air diverter 78 is contacted by the waves 24 to provide a mechanical scrubbing, abrading or cutting action, which on some fabrics improves the drape and surface of the fabric being conditioned. The roll 82, upstream of the deflector 78 will treat the other side of the fabric as the waves 24 in the fabric tend to assume a sinusoidal configuration.

It can readily be seen that a method and apparatus has been described which, in its basic form, improves the cleanliness, drape and flexibility of a fabric without physical contact of the fabric by a mechanical apparatus such as a sand roll or a flap to abrade the fabric surfaces. This allows increased treatment levels of the fabric without physical damage thereto and provides increased drape and flexibility in the treated fabric.

Although the preferred embodiments of the invention have been described, it is contemplated that changes may be made without departing from the scope or spirit of the invention and it is desired that the invention be only limited by the claims.

I claim:

1. The method of treating a web of fabric comprising the steps of: supplying a web of fabric at low tension, taking up the web of fabric supplied and breaking up the fiber-to-fiber bonds in the web of fabric between the supply and take-up thereof by projecting a plurality of low pressure, high velocity streams of gaseous fluid against only one side of the web of fabric in a direction opposite and substantially tangential to the path of travel of the web of fabric causing vibrations in the web of fabric to create saw-tooth waves therein having small bending radii which travel down the fabric to increase the drape and flexibility thereof.

2. The method of treating a web of fabric comprising the steps of: supplying a web of fabric at low tension, taking up the web of fabric supplied and breaking up the fiber-to-fiber bonds in the web of fabric between the supply and take-up thereof by projecting a low pressure, high velocity stream of gaseous fluid against only one side of the web of fabric in a direction opposite and substantially tangential to the path of travel of the web of fabric causing vibrations in the web of fabric to create saw-tooth waves therein having small bending radii which travel down the fabric to increase the drape and flexibility thereof.

* * * * *